United States Patent [19]

Michel et al.

[11] 3,947,145

[45] Mar. 30, 1976

[54] GAS TURBINE STATIONARY SHROUD SEALS

[75] Inventors: Frank Michel, Swarthmore; Egidio J. Ruffini, Havertown, both of Pa.

[73] Assignee: Westinghouse Electric Corporation, Pittsburgh, Pa.

[22] Filed: Oct. 7, 1974

[21] Appl. No.: 513,001

[52] U.S. Cl. ..... 415/217; 415/138; 415/219 R

[51] Int. Cl.[2] ..... F01D 9/02; F01D 9/04

[58] Field of Search ..... 415/136, 138, 139, 216, 415/217, 218, 219 R, 170 R, 172 A, 173 A

[56] References Cited

UNITED STATES PATENTS

| | | | |
|---|---|---|---|
| 3,393,894 | 7/1968 | Redsell | 415/217 |
| 3,519,366 | 7/1970 | Campbell | 415/138 |
| 3,542,483 | 11/1970 | Gagliardi | 415/217 |
| 3,728,041 | 4/1973 | Bertelson | 415/217 |
| 3,752,598 | 8/1973 | Bowers et al. | 415/173 A |

FOREIGN PATENTS OR APPLICATIONS

| | | | |
|---|---|---|---|
| 839,325 | 6/1960 | United Kingdom | 415/139 |
| 1,185,189 | 3/1970 | United Kingdom | 415/217 |

*Primary Examiner*—Henry F. Raduazo
*Attorney, Agent, or Firm*—F. A. Winans

[57] ABSTRACT

A seal is provided between adjacent stationary annular shroud members in a gas turbine. The shroud members have an axially directed gap disposed between their adjoining ends. Each adjoining end of each stationary shroud has a shoulder arrangement which provides support for a seal disposed across the gap. The shoulders on the ends of the shrouds provide restraint against radially inwardly directed dislocation, and a blade ring which supports the shroud members themselves, provides restraint against axial and radially outwardly directed dislocation. The seal prevents escape of hot motive fluid from the generally axially directed working fluid flow path.

3 Claims, 3 Drawing Figures

GAS TURBINE STATIONARY SHROUD SEALS

BACKGROUND OF THE INVENTION

1. Field of the Invention

This invention relates to gas turbines, and more particularly to sealing arrangements between adjacent stationary shroud members in a gas turbine.

2. Description of the Prior Art

Present high efficiency gas turbines produce more work per stage and have a high pressure drop across the first stage nozzle or stator vanes. To maintain high first stage efficiency it is important to minimize leakage around the stator vanes.

The first row vanes are usually manufactured in arcuate arrays of three or four vanes, with a clearance between adjacent arcuate arrays to permit expansion. Due to unequal heating in the combustion system and localized hot spots in any one arcuate array of vanes, each array may have a different circumferential expansion. Previous seal arrangements used on turbomachines utilized gaps permitting radial leakage between adjacent arcuate shroud members, or partial sealing between adjacent shrouds as shown in U.S. Pat. No. 3,728,041.

An object of this invention is to provide an easy to assemble sealing arrangement for shroud segments.

Another object of this invention is to provide a seal between adjacent shroud members that seals along the entire axial gap between adjacent arcuate arrays of shroud members.

SUMMARY OF THE INVENTION

This invention comprises a seal member disposed across the gap between adjacent arcuate stationary shroud members in a gas turbine. The neighboring edges of adjacent shroud members have a shoulder arrangement thereon which supports an elongated seal member. The shoulder portions on each adjacent shroud member prevent the seal member disposed thereon from dislocation in the radially inward direction. A blade ring, which provides axial and radial support for the shroud segments, also provides restraint in the radially outward direction and in the axial direction, for the elongated seal members. Each elongated seal member extends across the entire axial gap between adjacent shrouds, and is also disposed in a tongue and groove relationship with the blade rings which prevent radial and axial dislocation of the seal member.

BRIEF DESCRIPTION OF THE DRAWINGS

For a better understanding of the nature and objects of the invention, reference may be had to the following detailed description, taken in conjunction with the accompanying drawings in which.

DESCRIPTION OF THE PREFERRED EMBODIMENTS

Figure 1:
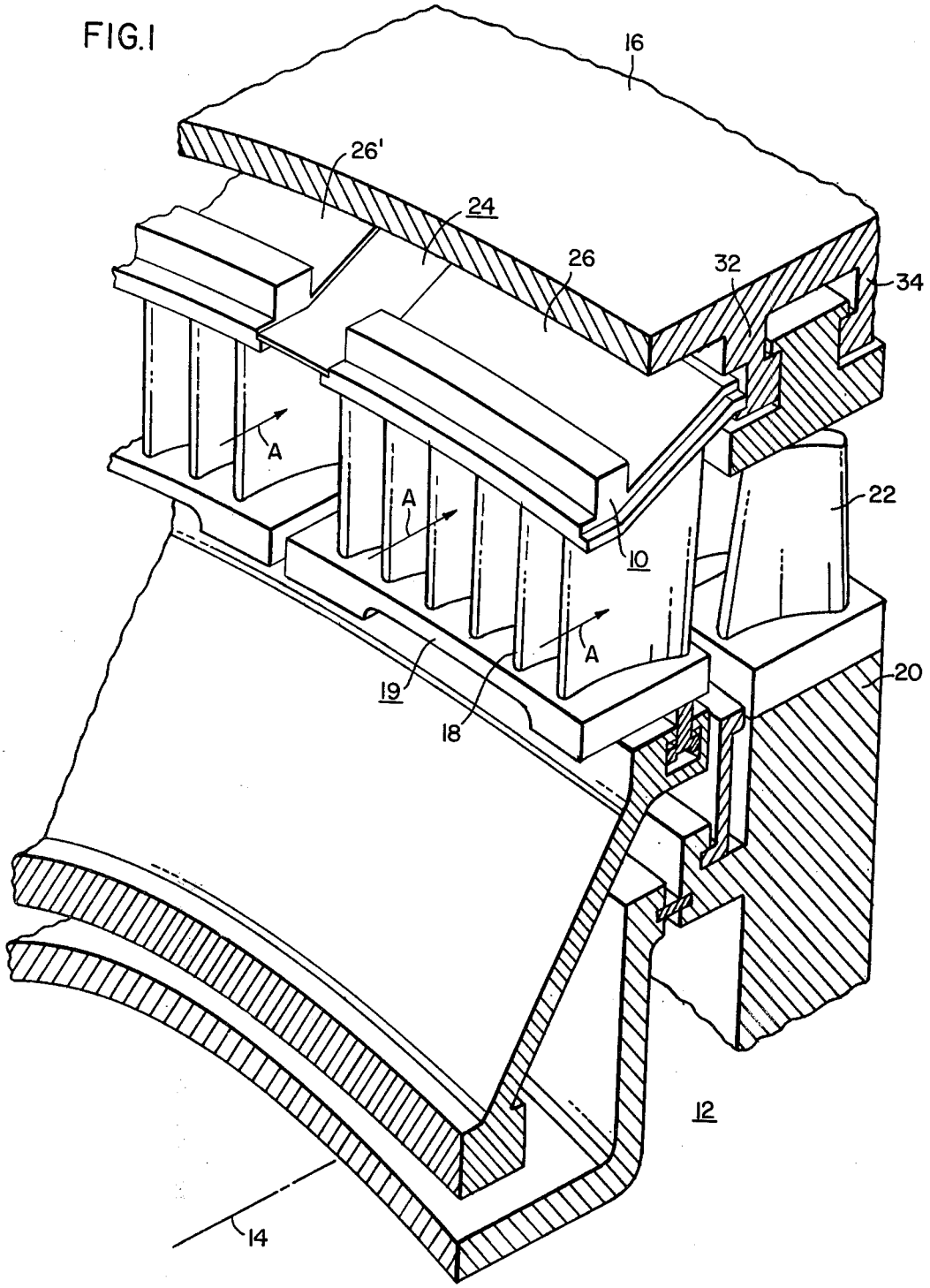
FIG. 1 is a perspective view of a portion of a gas turbine showing a portion of an annular array of stationary shroud members constructed in accordance with the principles of this invention.

Referring to the drawings in detail, particularly to FIG. 1, there is shown a portion of a stationary blade and shroud arrangement 10 of an axial flow gas turbine 12. The axial flow gas turbine 12 includes a turbine axis 14, an outer cylinder 16, a plurality of stationary blades 18, several of which comprise an arcuate array of blades or a blade segment 19, an annular array of which comprise an inlet vane or a stationary blade portion of a stage of gas turbine 12. The gas turbine 12 also includes at least one rotor disc 20.

Figure 2:
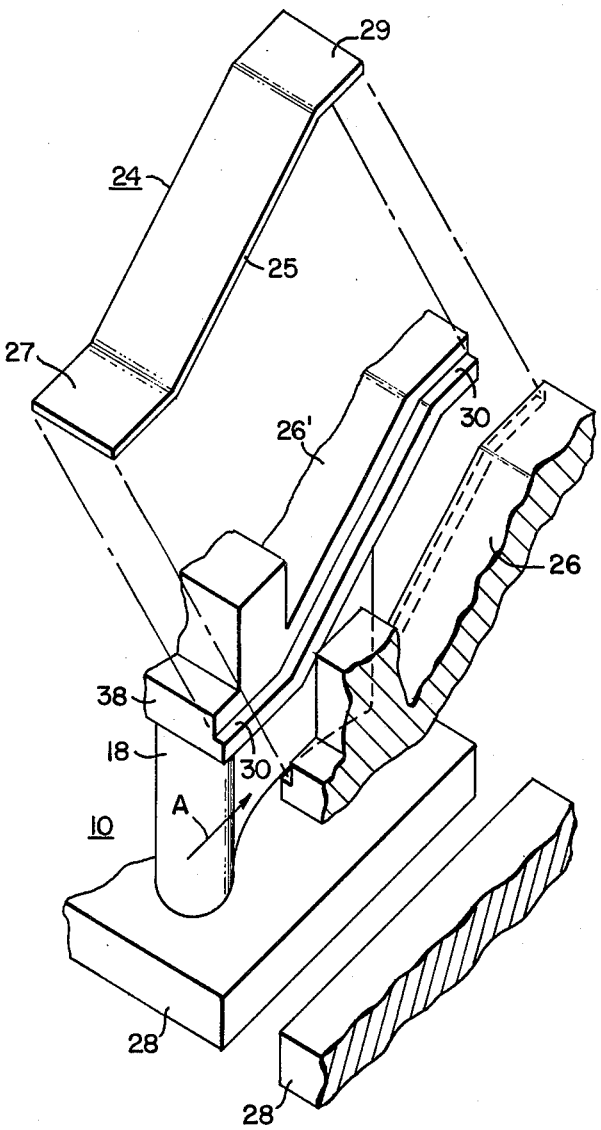
FIG. 2 is an enlarged view of a portion of the shroud and seal arrangement shown in FIG. 1; and, FIG. 3 is a partial side elevational view of the stationary shroud and seal member.

Hot motive fluid passes through the annular array of stationary blades 18, in a direction indicated by the arrow A, as shown in FIGS. 1 and 2. The hot motive fluid is a product of combustion from the ignition of fuel and air, in an array of combustion chambers, not shown, which are disposed generally upstream of the gas turbine 12. The hot motive fluid may pass through an alternating series of stationary blades 18, and rotating blades 22 as exemplified in FIG. 1. The hot motive fluid, upon striking the rotatable blades 22 imparts a force thereon causing them to rotate the rotor 20.

The stationary blade and shroud arrangement 10 includes an elongated seal member 24, an outer shroud portion 26, an inner shroud portion 28, and the stationary blades 18 being radially disposed between the shroud portions 26 and 28. The elongated seal member 24, is disposed across a gap between adjacent outer shroud members 26 and 26', as shown in FIGS. 1 and 2.

Each outer shroud member 26 and 26' has a shoulder portion 30 that extends the axial distance of the outer shroud portion 26 and 26'. The elongated seal member 24 is of a non-linear configuration, having a generally straight central portion 25 and end portions, 27 and 29, disposed at opposite obtuse angles thereto, as shown in FIG. 3.

The elongated seal member 24 which may be flexible, provides sealing for the hot motive fluid, preventing fluid from escaping the hot motive fluid flow path. The shoulder portions 30 provide sufficient sealing interface between said shroud member 26 and each seal member 24 along their common axial extent. A blade ring 32 is disposed within the outer cylinder 16, at the downstream end of the outer shroud member. Another blade ring 34 is disposed within the outer cylinder 16, at the upstream end of the outer shroud member 26. Each blade ring, 34 and 32, has arcuate annularly directed grooves 35 and 35' respectively for supporting a tongue portion 38, which extends off both the upstream and downstream ends of the outer shroud 26 along with the terminal ends of each seal member 24. The grooves 35 and 35' thus provide support and restraint in both the axial and radial direction for the elongated seal member 24.

Assembly of the stationary blade and shroud arrangement 10 includes inserting the tongue portions 38 of the blade segment 19 into the grooves 35' and 35 of the blade ring members 32 and 34 respectively. Between each blade segment 19, is an elongated seal member 24, which also mates with the blade rings 32 and 34, in a tongue and groove arrangement. This series of steps is performed until each blade ring 32 and 34, supports a semicircular array of blade segments 19 and elongated seal members 24 therebetween.

Figure 3:
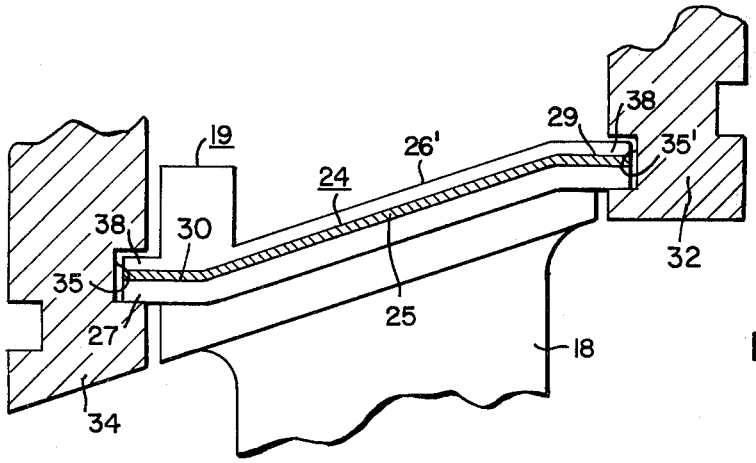

By having the elongated seal member 24 extend along the entire axial length of the outer shroud member 26, as shown in FIG. 3, the gap between adjacent outer shroud members 26 and 26' shown in FIG. 2 can be effectively sealed.

From the foregoing description, it is apparant that the invention provides a seal structure which is particularly suitable for utilization in conjunction with stationary blade segments in a gas turbine. However, the present seal structure is not limited in its application to the gas turbine, but may be utilized in elastic fluid machines of other types. The seal structure is relatively simple to construct and assemble and is efficient in operation.

Since numerous changes may be made in the above described construction and different embodiments of the invention may be made without departing from the spirit and scope thereof, it is intended that all subject matter contained in the foregoing description or shown in the accompanying drawings shall be interpreted as illustrative and not in a limiting sense.

What we claim is:

1. A seal structure for controlling leakage of hot motive fluid between adjacent stationary shroud segments in a gas turbine comprising: A turbine casing having at least one blade ring disposed within said casing, said blade ring defining radially inwardly projecting members, said members having axially opening opposed grooves, an annular array of stationary blades supported on their radially outer ends by a plurality of arcuately formed outer shroud segments and supported on their inner ends by a plurality of arcuately formed inner shroud segments; said outer shroud segments having axially opposed ends generally snugly received within said opposed grooves for supporting said blades and disposed therein so as to have a circumferential gap between adjacent shroud segments providing spatially separated facing end portions; each of said portions defining a generally circumferentially projecting shoulder extending generally through the axial extent of said outer shroud segments; a seal member disposed across said gap throughout the axial extent thereof to prevent leakage of fluid therepast and being in generally sealing engagement with said adjacent facing shoulder portions with the axial ends of said seal member received snugly within said opposed grooves of said blade ring for restraint against both radial and axial displacement.

2. A seal structure as recited in claim 1, wherein said seal member is generally elongated and has each opposed axial end portion disposed generally obtusely with respect to the plane of its body portion.

3. A seal structure as recited in claim 1, wherein said seal member is comprised of generally flexible material.

* * * * *